US008079097B2

(12) United States Patent
Deutsch

(10) Patent No.: US 8,079,097 B2
(45) **Date of Patent: *Dec. 20, 2011**

(54) CHILD'S TOILET TRAINING CHAIR

(76) Inventor: Diana Dorfman Deutsch, Brooklyn, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/660,264

(22) Filed: Feb. 22, 2010

(65) Prior Publication Data

US 2010/0154108 A1 Jun. 24, 2010

Related U.S. Application Data

(63) Continuation of application No. 11/389,364, filed on Mar. 23, 2006, now Pat. No. 7,665,157.

(51) Int. Cl.
*A47K 11/04* (2006.01)

(52) U.S. Cl. ..... 4/483; 4/902; 4/905; 297/338

(58) Field of Classification Search ..... 4/483, 905, 4/902, 239, 449, 458, 476–480; 197/338; 297/338

See application file for complete search history.

(56) References Cited

U.S. PATENT DOCUMENTS 2,134,135 A * 10/1938 Lefevre ..... 4/239
2,547,408 A 4/1951 Owen
2,550,811 A 5/1951 Herbert
3,258,291 A 6/1966 Ezquerra
3,364,478 A 1/1968 Waard
3,575,465 A * 4/1971 Dolby et al. ..... 297/338
4,798,412 A 1/1989 Kohus
4,854,638 A 8/1989 Marcus
5,183,311 A * 2/1993 Meeker et al. ..... 297/338
5,787,518 A 8/1998 Mendelovich
6,263,521 B1 * 7/2001 Pi ..... 4/484
6,634,712 B2 10/2003 Gamble

OTHER PUBLICATIONS

PCT/US07/03828, Written Opinion of the International Searching Authority, mailed Nov. 1, 2007.

PCT/US07/03828, International Preliminary Report on Patentability, mailed Jul. 28, 2008.

* cited by examiner

*Primary Examiner* — Gregory Huson
*Assistant Examiner* — Janie Christiansen
(74) *Attorney, Agent, or Firm* — Abelman, Frayne & Schwab

(57) ABSTRACT

A child's toilet training chair includes a seat supporting structure and an adjustable seat that can be positioned at an acute angle relative to the horizontal. The front section of the seat is pivotally attached to a front portion of the supporting structure and the rear portion of the seat is provided with at least one engagement member that releasably mates with one of a plurality of vertically-spaced receiving elements in the chair back.

17 Claims, 6 Drawing Sheets

CHILD'S TOILET TRAINING CHAIR

CROSS-REFERENCES TO RELATED APPLICATIONS

The present invention is a continuation of "Child's Toilet Training Chair," U.S. application Ser. No. 11/389,364, filed Mar. 23, 2006, now U.S. Pat. No. 7,665,157, the entire contents of which is herein incorporated by reference.

FIELD OF THE INVENTION

The invention relates to the construction and use of a child's toilet training chair, commonly referred to as a potty chair.

BACKGROUND OF THE INVENTION

Small children are typically introduced to toilet training by encouraging them to sit on an appropriately scaled, but otherwise conventional appearing chair having a back, armrests, a seating area with an opening and, optionally a folding seat cover, the latter corresponding to a conventional toilet seat cover. The underside of the chair is fitted with means for retaining a waste-receiving receptacle having a handle or other structure to facilitate its removal after use, carrying and emptying of the waste from the receptacle into the toilet.

In these toilet training chairs, or potty chairs, of the prior art, the seat typically forms part of the unitary structure of the chair and is positioned parallel to the floor or other surface upon which the training chair is positioned.

In an apparent effort to encourage the child's early acceptance and use of the toilet, a wide variety of structures have been proposed for toilet training. These include molded plastic structures in the form of various animals, including a bear, and vehicles, including tugboats, automobiles and trucks. All of these devices for the potty training of toddlers are provided with a substantially horizontal seating position with an opening below which is positioned a waste receiving receptacle. In some cases, the child straddles the structure and in others assumes a normal seated position.

Toilet training is usually initiated after a toddler has progressed to the point of being able to walk around with a reasonable level of competence. It has been noted that toddlers wearing diapers will typically and commonly assume a squatting position for the purpose of initiating a bowel movement. The squatting position is also assumed by adults living in aboriginal or other primitive communities which have neither the benefit of indoor toilets, or outdoor latrines or other facilities for the sanitary disposal of their excrement.

It is therefore an object of the present invention to provide a potty training chair that is configured to encourage a toddler's early use by permitting the assumption of a more natural posture at the early stage of training.

A further object of the invention is to provide a toilet training chair for which the seating position can be adjusted during the course of the child's training.

SUMMARY OF THE INVENTION

The deficiencies of the prior art are overcome, and other advantages described herein are achieved by providing a child's toilet training chair having an adjustable seat that is rearwardly declined at an acute angle from the horizontal.

The chair includes a seat supporting structure and a seat with a central opening. The seat has a front section, a rear section, and a waste receiving receptacle. Preferably, the front section is pivotally attached to a front portion of the support structure. The rear section is provided with at least one engagement member, and the supporting structure of the chair preferably includes a back portion extending to a position proximate the base of the chair. The back has a plurality of vertically spaced receiving elements for securely receiving the at least one engagement member of the seat, of which the topmost receiving element is positioned to align the seat in a substantially horizontal position for use and the lowermost receiving element is positioned to engage the seat at a rearwardly declined acute angle for use. The waste receiving receptacle is removably secured in a position below the underside of the seat and surrounds the central opening in the seat. The placement of the engagement member in the lowermost receiving element in the back of the chair positions the seat for use by a child in a low-squatting posture.

BRIEF DESCRIPTION OF THE DRAWINGS

The construction and use of the present invention will be further described in the following detailed description that is to be read in conjunction with the accompanying drawings in which.

Figure 1:
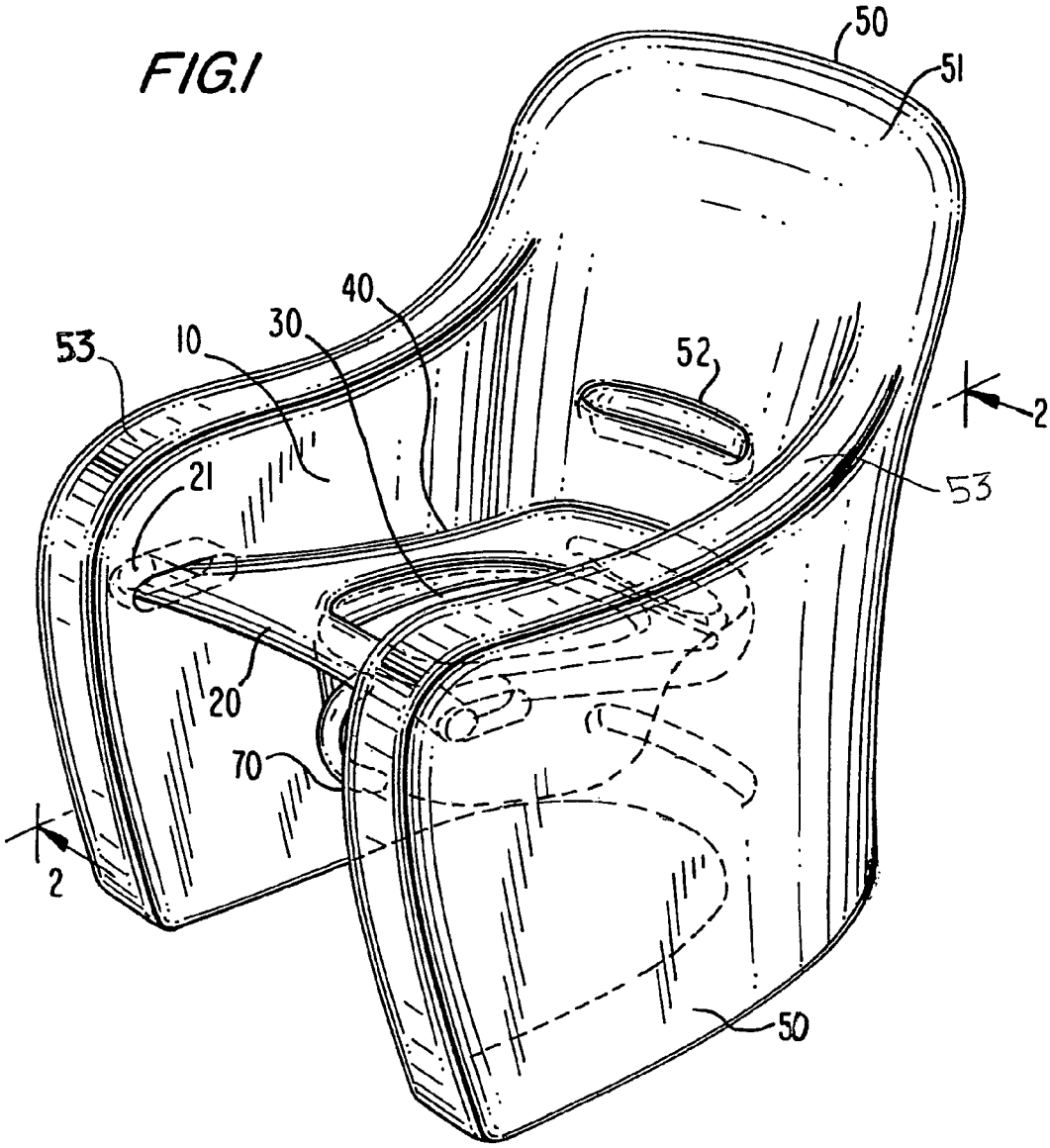
FIG. 1 is a front perspective view of a child's toilet training chair.

To facilitate an understanding of the invention, the same reference numerals have been used, when appropriate, to designate the same or similar elements that are common to the figures. Unless stated otherwise, the features shown and described in the figures are not drawn to scale, but are shown for illustrative purposes only.

DETAILED DESCRIPTION OF THE PREFERRED EMBODIMENT

Although the present invention will be described herein with reference to a child's toilet training chair, it should be understood that the apparatus of the present invention may be used by adults as an appropriately scaled toilet chair, e.g., for the aged or disabled who may benefit from the lowest squatting position.

Referring to FIGS. 1-4, a child's toilet training chair 1 includes a seat 10, a seat supporting structure 50, and a waste receiving receptacle 70. The seat 10 has a front section 20 and a rear section 40. The seat supporting structure 50 includes a back 51, receiving elements 52 and arms 53. The waste receiving receptacle 70 includes an upper rim 71, a disposable bag 72, and a handle 73. The chair 1 can be made of a molded rigid plastic material, wood, a combination of these materials or other materials known to the art. In a preferred embodiment, the seat 10 is a separate element that is removably attachable to the support 50. This construction will facilitate manufacture and any cleaning that may be necessary following use.

The front section 20 has a pair of opposing posts 21, which extend laterally from-side edges of the front section 20 proximate front edges of the front section 20. The opposing posts 21 allow the front section 20 to be pivotally attached to a front portion of the supporting structure 50. The rear section 40 has a central opening 30 through which baby's bodily wastes pass. The central section of leading edge of the seat 10 has a convex curvilinear form. The seat 10 is removably secured to the supporting structure 50 by positioning the seat 10 in a generally vertical position and engaging first one opposing post 21 in one end of the opposing openings 54 and twisting the opposing post 21 to position it in the opposing elongated opening 54.

In a further preferred embodiment, (not shown), the arms of the chair move with the seat 10 and remain generally parallel with the plane of the seat during adjustment. As will be apparent to those of ordinary skill in the art, a wide variety of other structural configurations can be employed to achieve a functionally equivalent structure. For example, the back portion 51 can be higher or lower than shown in the attached illustrations and/or can be provided with fanciful design elements. The position and shape of the arms formed by side portions 10 can also be varied and, e.g., provided with hand holds to assist the user in rising from the squatting position shown in FIG. 3.

Figure 5:
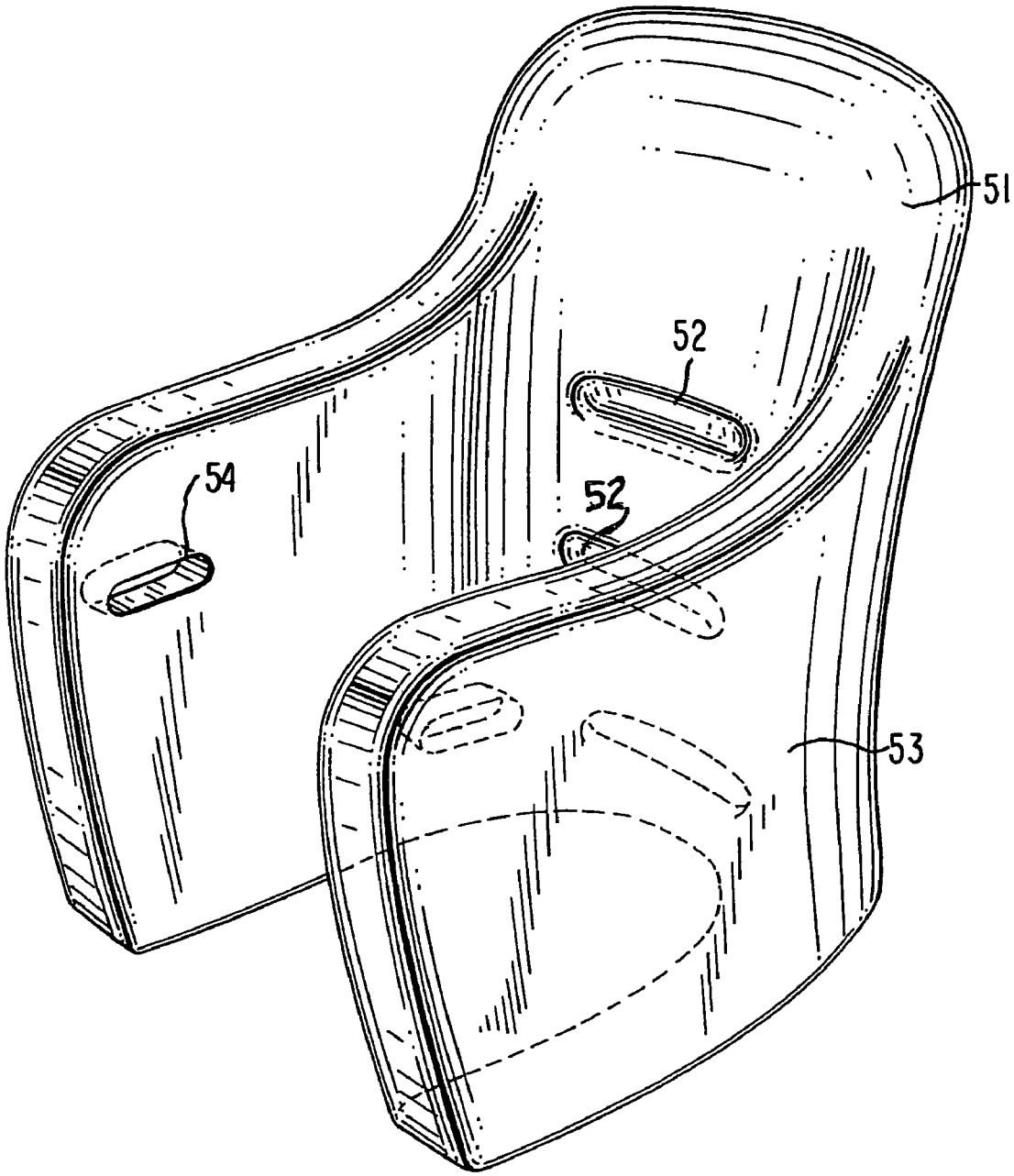
FIG. 5 is a front perspective view of a seat-supporting structure of the child's toilet training chair.

Referring to FIG. 5, the supporting structure 50 has a back 51 and arms 53, which, in combination, form a U-shaped plane figure. The supporting structure 50 is generally U-shaped having an exterior surface extending from the base up to the arms and continuing up the back 51 to form a unitary structure. The arms 53, fixed with respect to the supporting structure 50, extend to the back 51. A change in the position of the seat 10, via a change of receiving elements 52 to which the seat 10 is secured, also changes the position of the arms 53 with respect to the supporting structure 50 of the chair 1.

The front of the seat 10 is about 6 inches above the supporting surface, and the back portion extends at least 12 inches above the base of the chair 1. The seat 10 forms an acute angle of X° to the horizontal when the seat 10 is engaged in the lowermost receiving element 52. The angle is determined with respect to the other elements of the chair's construction, and preferably is at most 45°.

Elongated openings 54 having an elliptical shape are formed in opposing vertically extending inner sidewalls of the arms 53 proximate front edges of the supporting structure 50. The elongated openings 54 receive the opposing posts 21 of the seat 20 slidingly, which renders the rears seat 40 moveable with respect to the back 51 of the chair 1.

Figure 2:
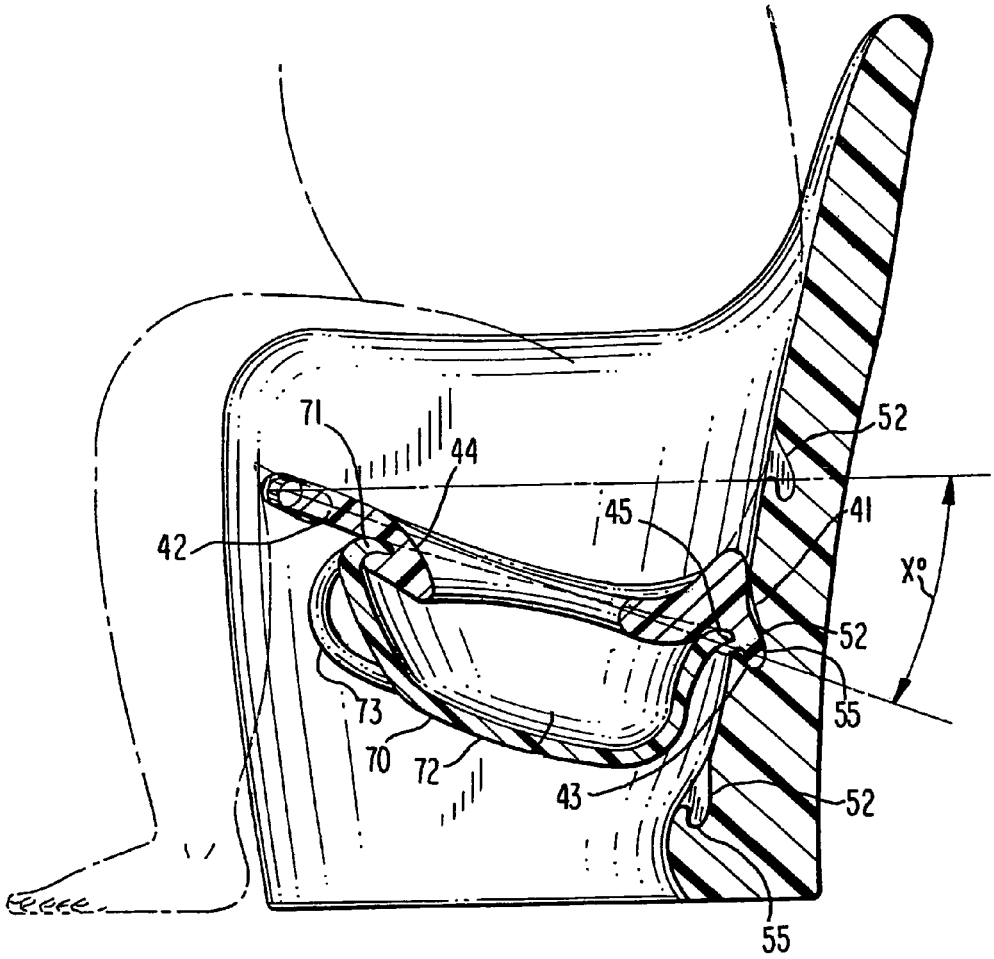
FIGS. 2-4 are cross sectional views of the child's toilet training chair taken along line 2-2 in FIG. 1.
Figure 3:
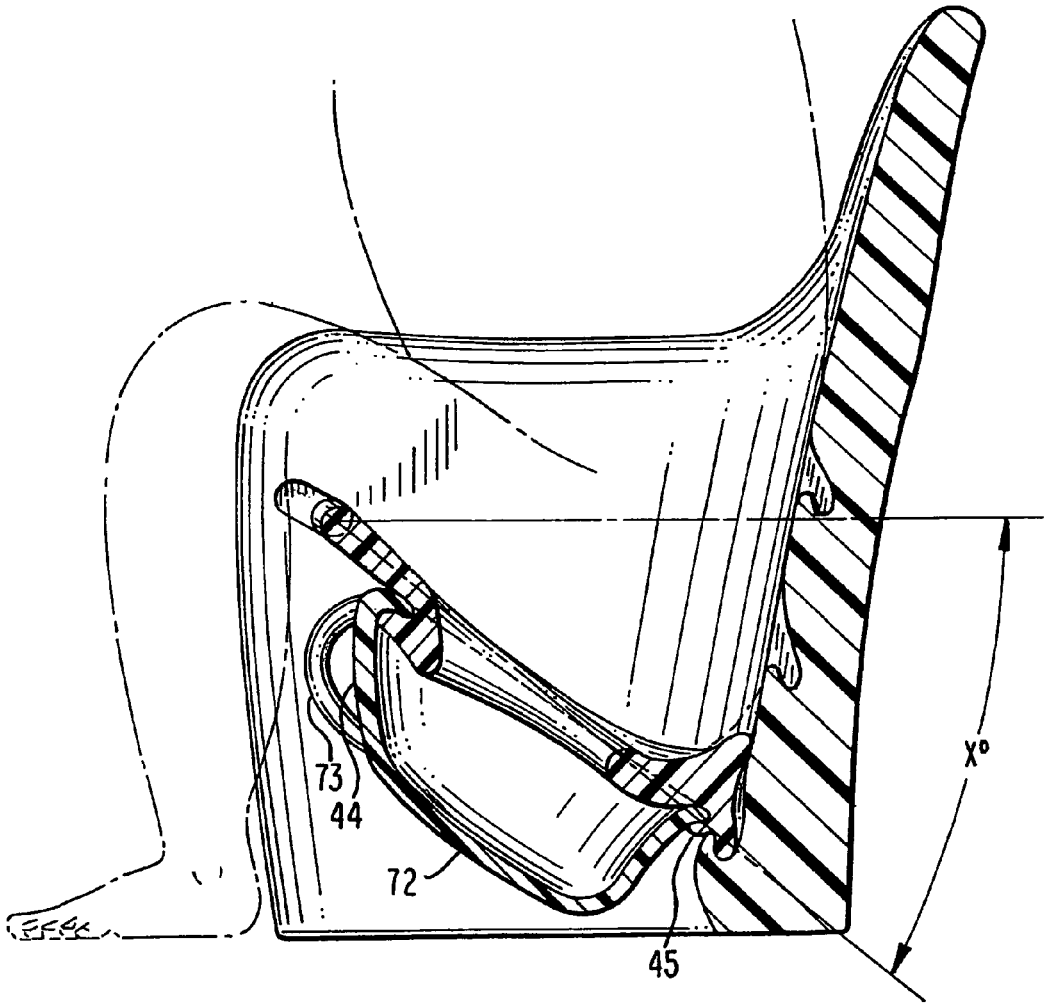
Figure 4:
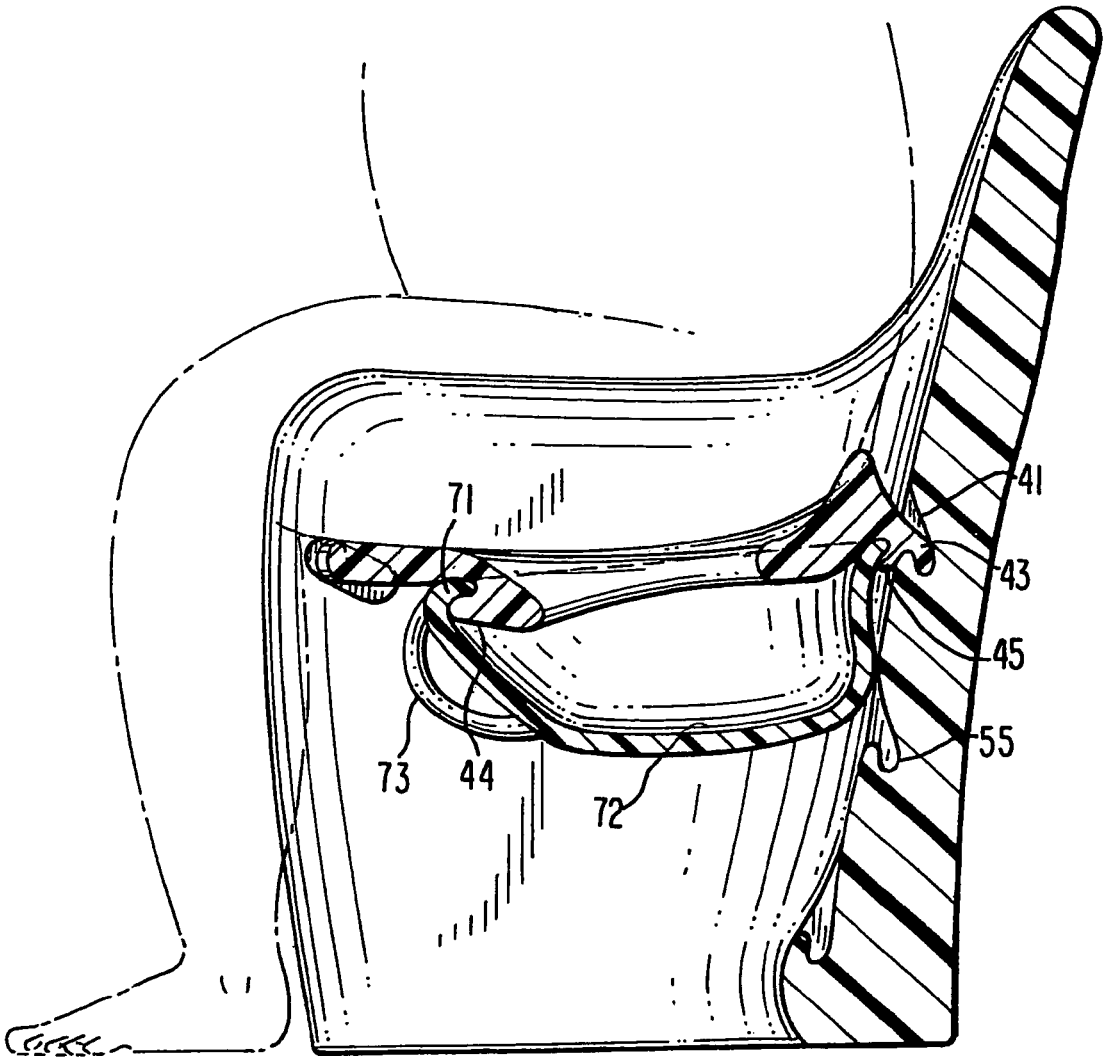

Referring to FIGS. 2-5, the lower portion of back 51 extends to a position proximate the base of the chair 1. The back 51 has a plurality of vertically-spaced receiving elements 52, which allows the seat 10 to be disposed at a variety of angles against the back. The receiving elements 52 securely receive the engagement member 41 of the seat 10. As shown in FIGS. 2-4, the topmost receiving element 52 is positioned to align the seat 10 in a substantially horizontal position and the lowermost receiving element 52 is positioned to engage the seat 10 at a rearwardly declined acute angle. These diverse angled positions of the seat 10 permits the baby to sit in diverse positions.

Referring to FIGS. 2-5, an engagement member 41 is positioned on the underside 42 of the rear section 40 proximate the supporting structure 50. The engagement member 41 includes a locking portion 43. The receiving element 52 also includes a locking portion 55. The locking portion 43 is configured to engage and secure releasably a locking portion 55 of a receiving element 52, when the seat 20 is positioned at the receiving element 55 of the receiving element 52.

The seat 10 also includes retaining member 44, 45, that are formed on the underside 42 of the seat 10 proximate the central opening 30 and are configured to releasably secure the waste receiving receptacle 70. As will be apparent to those of ordinary skill in the art, a wide variety of other means for engaging and securing the receptacle 70 can be used.

Figure 8:
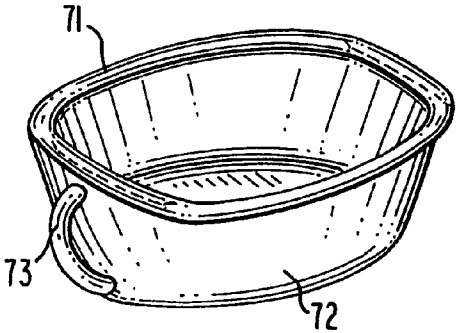
FIG. 8 is a top perspective view of a waste receiving receptacle of the child's toilet training chair.
Figure 9:
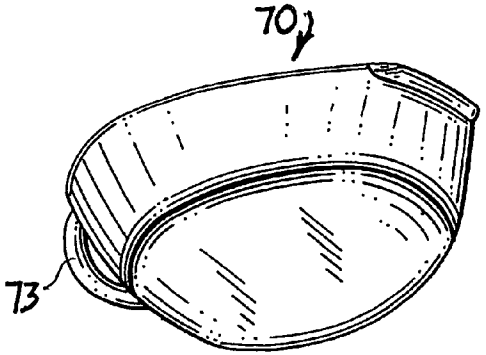
FIG. 9 is a bottom perspective view of the waste receiving receptacle of the child's toilet training chair.
Figure 6:
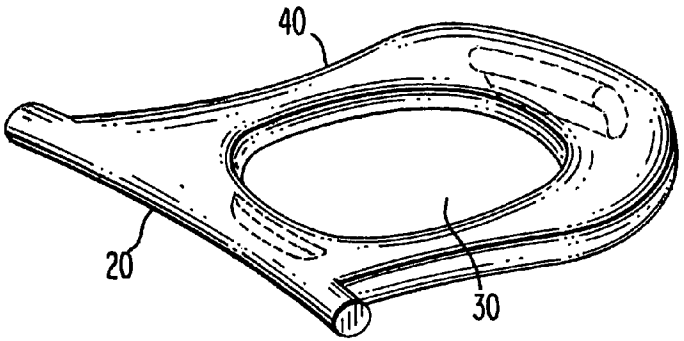
FIG. 6 is a top perspective view of a seat of the child's toilet training chair.
Figure 7:
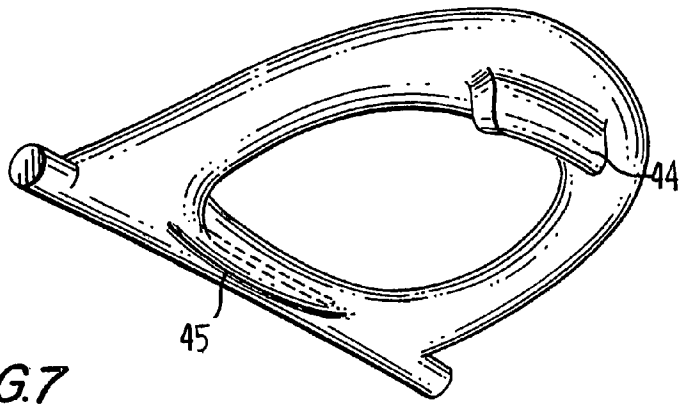
FIG. 7 is a bottom perspective view of the seat.

Referring to FIGS. 4, 7, 8, the waste receiving receptacle 70 is removably secured in a position below the underside 42 of the seat 10 and surrounds the central opening 30 to thereby receive and retain liquid and solid bodily wastes. The waste receiving receptacle 70 includes an upper rim 71 and a handle 73. The upper rim 71 has an elliptical shape conforming substantially to the central opening 30, but larger. The upper rim 71 is removably secured to retaining members 44, 45 that depend from the underside 42 of seat 10. The disposable plastic bag (not shown) can be positioned over the rim to receive baby's bodily waste. The handle 73 is provided to facilitate the removal of the waste containing receiving receptacle. In a preferred embodiment, the receptacle 70 is sufficiently flexible or pliable to permit the slight deformation required to engage rear retaining member 45 and then snap from rim 71 into a secured position with front retaining member 44. Receptacle 70 is preferred removed from the front of the chair 10.

Although a preferred embodiment that incorporates the teachings of the present invention has been shown and described in detail, those skilled in the art can readily devise many other varied embodiments that are within the scope of the invention as determined by the claims that follow.

I claim:

1. A toilet training apparatus, which comprises a stationary rigid seat supporting structure and a separate adjustable seat, wherein:

said seat supporting structure includes opposed side portions and a rear portion attached to said side portions, said seat supporting structure terminating in a depending base portion and configured to be supported on a flat surface, said rear portion of said seat supporting structure including a backrest extending upwardly from said depending base portion; and said adjustable seat has a central opening, a forwardmost edge and a rearwardmost portion extending between said side portions of said supporting structure and to said rear portion of said seat supporting structure, said seat being pivotally mounted to said side portions of said seat supporting structure by pivotal mounting means proximate said forwardmost edge, said rearwardmost portion of said seat being configured to selectively lockingly engage one of a plurality of correspondingly configured and generally vertically spaced apart mating recesses in said rear portion of said seat supporting structure, a lowermost mating recess in said rear portion of said seat supporting structure being positioned to support said seat at an acute angle with respect to the flat surface, so as to accommodate a user in contact therewith in a low squatting position;

a distance from the flat surface to said forwardmost edge of said seat remaining substantially constant when said seat is moved from one of said mating recesses to another in said rear portion of said seat supporting structure.

2. The apparatus according to claim 1, wherein said pivotal mounting means of said seat is moveably retained in said supporting structure for selective disengagement and engagement with said recesses in said rear portion for repositioning said seat.

3. The apparatus according to claim 1, wherein the flat surface is substantially horizontal and an uppermost recess is located such that said seat is in a substantially horizontal position when said seat is engaged in said uppermost recess.

4. The apparatus according to claim 3, wherein at least one of said plurality of spaced recesses is provided intermediate said uppermost and lowermost recesses.

5. The apparatus according to claim 4, wherein a waste receptacle is removably attached to said seat below said central opening in said seat.

6. The apparatus according to claim 5, wherein said waste receptacle is deformable to facilitate its installation and removal from below said seat.

7. The apparatus according to claim 1, wherein said seat supporting structure is formed of a molded plastic material.

8. The apparatus according to claim 7, wherein said seat supporting structure is generally U-shaped.

9. A self-supporting toilet training chair for use by a user in a plurality of positions which includes at least one squatting seated position, said chair including a seat supporting member and a seat, wherein:

said seat has a generally planar upper seating surface having a generally central opening, the underside of said seat being adapted to releasably retain a waste receiving receptacle below said central opening, said seat having a forwardmost edge and an opposed rear portion, and said seat supporting member has opposed side portions and a rear portion which includes an immovable backrest, said seat supporting member terminating in a base portion configured and dimensioned to position said seat supporting member on a flat surface, said immovable backrest extending continuously upwardly from said base portion, said seat supporting member being configured to receive said seat in pivotally mounted attached relation to said side portions by pivotal mounting means, said seat being removably and securely engageable with a lowermost one of a plurality of vertically spaced recesses in said rear portion of said seat supporting member, whereby said seat assumes a position which is declined from said forwardmost edge to support the user in the squatting position on said seat.

10. The apparatus according to claim 9, wherein the flat surface is generally horizontal and said rear portion of said seat supporting member includes an uppermost recess to receive said rear portion of said seat, in which position said upper seating surface of said seat is generally horizontal.

11. The apparatus according to claim 10, wherein said rear portion of said seat supporting member includes at least one recess intermediate said uppermost recess and said lowermost recess.

12. The apparatus according to claim 11, wherein said pivotal mounting means of said seat is moveably retained in said supporting structure for selective disengagement and engagement with said recesses in said rear portion for repositioning said seat.

13. The apparatus according to claim 9, wherein said waste receiving receptacle is removably attached to said seat by retaining members that depend from the underside of said seat.

14. The apparatus according to claim 13, wherein said waste receptacle is deformable to facilitate its installation and removal from below said seat.

15. The apparatus according to claim 14, wherein said seat supporting structure is formed of a molded plastic material.

16. The apparatus according to claim 15, wherein said seat supporting structure is generally U-shaped.

17. A self-supporting toilet training chair for use by a small child in a squatting seated position, said chair including a seat supporting member and a seat, wherein:

said seat has a generally planar upper seating surface having a generally central opening, the underside thereof being configured and adapted to releasably retain a waste receiving receptacle below said central opening, said seat having a forwardmost edge and an opposed rear portion, and said seat supporting member has opposed side portions and a rear portion which includes an immovable backrest, said seat supporting member terminating in a base portion configured to position said seat supporting member on a flat generally horizontal surface, said immovable backrest extending upwardly from said base portion, said seat supporting member being structured and dimensioned to receive said seat in pivotally mounted attached relation to said side portions and to securely lockingly engage said rear portion of said seat in one of a plurality of vertically spaced mating recesses in said rear portion of said seat supporting member, a lowermost mating recess in said rear portion of said seat supporting member being located such that when said seat is engaged in said lowermost mating recess, said seat is relatively steeply declined from said forwardmost edge to support the user in a squatting position on said seat, a distance from the flat generally horizontal surface to said forwardmost edge of said seat being substantially constant when said seat is moved from one to another of said mating recesses in said rear portion of said seat supporting structure.

* * * * *